US012715631B2

(12) United States Patent
Ponti

(10) Patent No.: US 12,715,631 B2
(45) Date of Patent: Aug. 25, 2026

(54) METHOD FOR PACKAGING ARTICLE IN CARDBOARD BOX REALIZED STARTING FROM CONTINUOUS CARDBOARD STRIP

(71) Applicant: C.M.C. S.P.A., Citta' di Castello (IT)

(72) Inventor: Francesco Ponti, Citta' di Castello (IT)

(73) Assignee: C.M.C. S.P.A., Citta' di Castello (IT)

( * ) Notice: Subject to any disclaimer, the term of this patent is extended or adjusted under 35 U.S.C. 154(b) by 0 days.

(21) Appl. No.: 19/116,374

(22) PCT Filed: Sep. 29, 2023

(86) PCT No.: PCT/IB2023/059783

§ 371 (c)(1),
(2) Date: Mar. 28, 2025

(87) PCT Pub. No.: WO2024/074958

PCT Pub. Date: Apr. 11, 2024

(65) Prior Publication Data

US 2025/0256873 A1 Aug. 14, 2025

(30) Foreign Application Priority Data

Oct. 3, 2022 (IT) ..... 102022000020238
May 10, 2023 (IT) ..... 102023000009300

(51) Int. Cl.

| | |
|---|---|
| ***B65B 5/02*** | (2006.01) |
| ***B65B 5/04*** | (2006.01) |
| ***B65B 11/00*** | (2006.01) |
| ***B65B 43/10*** | (2006.01) |

(52) U.S. Cl.

CPC ..... *B65B 5/024* (2013.01); *B65B 5/04* (2013.01); *B65B 11/004* (2013.01); *B65B 43/10* (2013.01)

(58) Field of Classification Search

CPC ..... B65B 5/024; B65B 5/04; B65B 11/004; B65B 43/10

See application file for complete search history.

(56) References Cited

U.S. PATENT DOCUMENTS

| | | | | |
|---|---|---|---|---|
| 1,684,725 A * | 9/1928 | Boeye | B65D 5/323 29/432.2 |
| 3,099,379 A * | 7/1963 | Stease | B65D 5/323 229/122.26 |
| 4,186,834 A * | 2/1980 | Krack | B65D 85/64 206/320 |
| 11,618,233 B2 * | 4/2023 | Capoia | B31B 50/20 493/355 |

FOREIGN PATENT DOCUMENTS

| | | |
|---|---|---|
| EP | 2890554 | 7/2015 |
| EP | 3388354 | 10/2018 |
| WO | 2018122756 | 7/2018 |

OTHER PUBLICATIONS

"International Search Report (Form PCT/ISA/210) of PCT/IB2023/059783", mailed on Feb. 9, 2024, pp. 1-4.
"Written Opinion of the International Searching Authority (Form PCT/ISA/237) of PCT/IB2023/059783", mailed on Feb. 9, 2024, pp. 1-7.

* cited by examiner

*Primary Examiner* — Shelley M Self
*Assistant Examiner* — David G Shutty
(74) *Attorney, Agent, or Firm* — JCIPRNET

(57) ABSTRACT

The method enables packaging an article in a cardboard box which is realised starting from a continuous cardboard strip with no waste or scraps of material.

8 Claims, 13 Drawing Sheets

METHOD FOR PACKAGING ARTICLE IN CARDBOARD BOX REALIZED STARTING FROM CONTINUOUS CARDBOARD STRIP

CROSS-REFERENCE TO RELATED APPLICATION

This application is a 371 of international application of PCT application serial no. PCT/IB2023/059783, filed on Sep. 29, 2023 which claims the priority benefit of Italian application no. 102022000020238, filed on Oct. 3, 2022 and Italian application no. 102023000009300, filed on May 10, 2023. The entirety of each above-mentioned patent application is hereby incorporated by reference herein and made a part of this specification.

FIELD OF THE INVENTION

The present invention relates to the technical sector concerning the packaging of articles inside cardboard boxes obtained starting from a continuous cardboard strip.

DESCRIPTION OF THE PRIOR ART

Methods and procedures are known for packaging articles internally of relative cardboard boxes obtained starting from a continuous cardboard strip, instead of from blanks, already cut, and various dimensions stored in relative stores.

For example, document EP 2 890 554 describes a procedure for obtaining, starting from a continuous cardboard strip, a cardboard blank on which an article is arranged, about which, following this, the cardboard blank is folded to obtain a closed cardboard box containing the article inside it.

The procedure described in this document includes unwinding a continuous cardboard strip from a relative fanfold store, and performing, taking into account the effective dimensions of the article to be packaged, a transversal cut on the continuous strip so as to obtain a cardboard sheet having suitable dimensions for obtaining a blank suited for packaging an article.

At least a pair of longitudinal score lines are realised on the cardboard sheet, which are parallel to the two longitudinal borders of the cardboard sheet, so as to define, on the cardboard sheet, a central sector and two lateral sectors, by the sides of the central sector.

In the central sector of the cardboard sheet, transversal score lines are made so as to identify at least four faces which will then go to constitute a base wall, a first pair of lateral walls and an upper wall of the box.

A series of transversal cuts are made transversally to the two lateral sectors of the cardboard sheet, which extend to the two longitudinal score lines to define a series of lateral portions which remain laterally projecting with respect to the central sector of the sheet, and hinged to the central sector at the two longitudinal score lines.

A part of the lateral portions is then folded on parts of the central section of the cardboard sheet, at the faces destined to constitute the first pair of lateral walls and the upper wall of the box, so that the walls are constituted by a double layer of cardboard, and then reinforce.

The remaining two lateral portions, positioned instead at the face of the central sector destined to constitute the base wall of the box, will constitute a second pair of lateral walls of the box.

The procedure described in this document also includes resting an article on the face of the central sector of the cardboard sheet which will then constitute the base wall of the box, and then folding, about the article, the remaining three faces of the central sector and the remaining lateral portions up to completely wrapping the article in a box having a base wall, a first pair of lateral walls, an upper wall and a second pair of lateral walls.

A procedure of this type, though on the one hand enabling packaging an article in a cardboard box starting from a continuous cardboard strip, and therefore saving space without having recourse to the presence of various stores each containing die-cut blanks of various dimensions, still requires having available a cardboard strip having a width that is significantly larger with respect to the width of the articles to be packaged, as the lateral portions of the cardboard blank must be folded on portions of the central section of the blank.

Further, realising the transversal cuts means creating scraps and waste of material.

In substance, then, the carrying out of the procedure described in this document requires a large consumption and waste of cardboard.

SUMMARY OF THE INVENTION

The aim of the present invention is therefore to describe a new method for packaging an article in a cardboard box made starting from a continuous cardboard strip able to obviate the above-mentioned drawbacks.

In particular, an aim of the present invention is to describe a new method for packaging an article inside a cardboard box made starting from a continuous cardboard strip, which enables effectively obtaining the packaging of the article inside a relative cardboard box, while eliminating all cardboard waste or scraps, thus reducing costs.

The above-mentioned advantages are fully obtained with a method for packaging an article inside a cardboard box realised starting from a continuous cardboard strip according to the contents of the claims.

DESCRIPTION OF THE PREFERRED EMBODIMENTS

Preferred embodiments of the carrying out of the method of the invention are described in the following with reference to the appended tables of drawings, in which.

Figure 1:
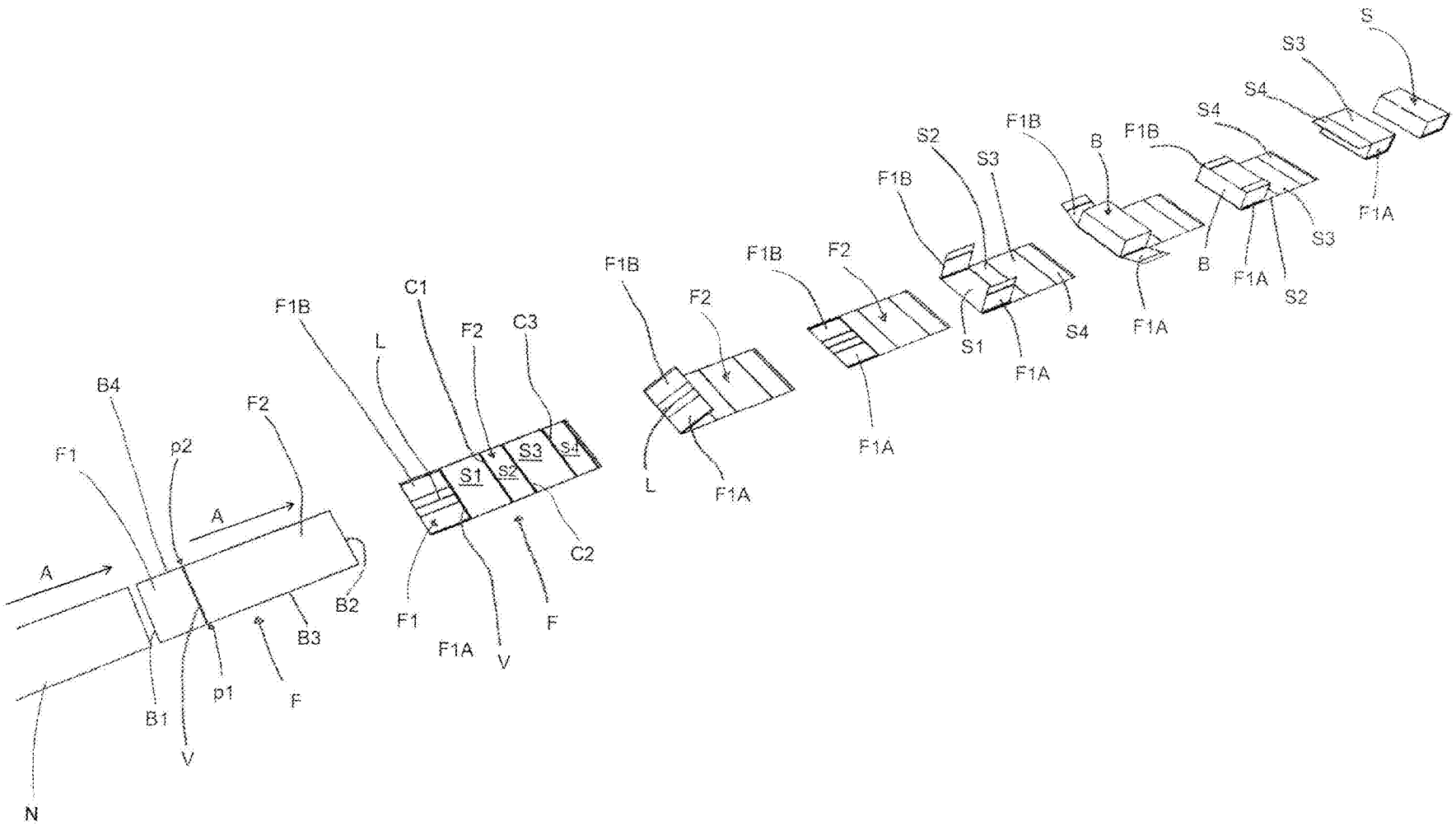
FIG. 1 illustrates, in a schematic perspective view, a first preferred sequence of steps of the method of the invention for packaging an article internally of a cardboard box realised starting from a continuous cardboard strip.

FIG. 1 schematically illustrates a possible operating sequence of a first preferred embodiment of the method of the invention for packaging an article (B) in a cardboard box(S) which is realised starting from a continuous cardboard strip (N).

Usually an article (B) to be packaged has a parallelepiped shape, or polyhedric with six faces.

In practice, therefore, the article (B) to be packaged comprises a base face, four lateral faces (B1L, B2L, B3L, B4L), facing two-by-two and for example parallel, and an upper face (BS).

The cardboard box(S) which is to be formed for packaging an article will therefore have to have a base wall (SB), four lateral walls (SL1, SL2, SL3, SL4) and an upper wall (SU), in particular four lateral walls (SL1, SL2, SL3, SL4) of the cardboard box(S) that is to be realised must have a height of at least equal to the height of the four lateral faces (B1L, B2L, B3L, B4L) of the article (B) to be packaged.

The present invention concerns a method for packaging an article (B) in a cardboard box(S) which is realised starting from a continuous cardboard strip (N) with no waste or exuberance of cardboard.

Figure 2:
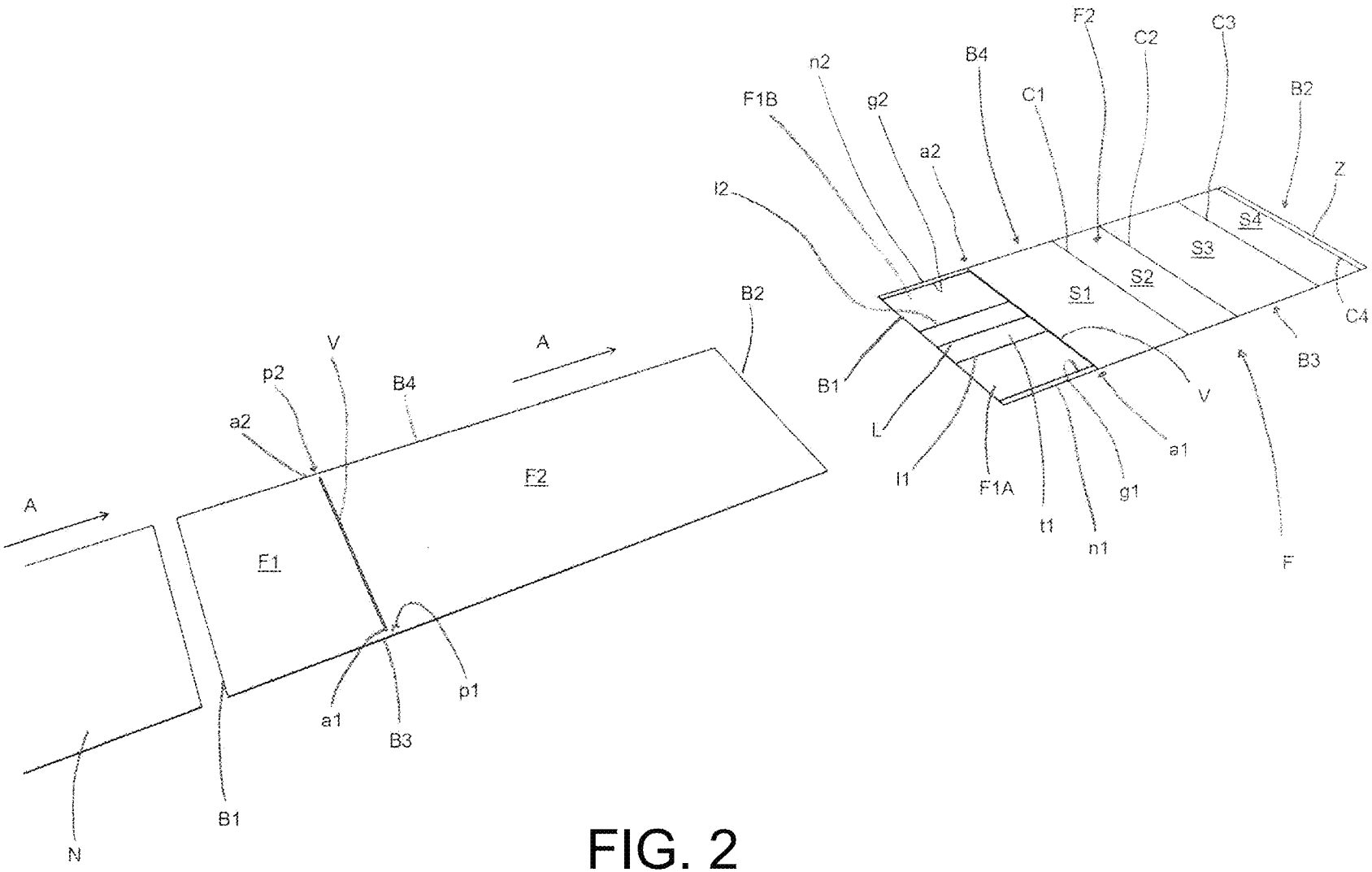
FIGS. 2 to 6 illustrate, in respective lateral schematic perspective views, special steps of the method of the invention according to the preferred embodiment of FIG. 1.

In the preferred embodiment illustrated in the figures of the drawings, the method illustrated in FIGS. 1-6 comprises advancing a continuous cardboard strip (N), for example having a width that is at least equal to the width of the base wall of the article to be packaged, along an advancement direction (A) and carrying out cutting operations, during the advancement of the continuous cardboard strip (N) along the advancement direction (A) so as to obtain, from the continuous cardboard strip (N), a single cardboard sheet (F) having:

- a first transversal edge (B1), a second transversal edge (B2) parallel to the first transversal edge (B1), a first longitudinal edge (B3) and a second longitudinal edge (B4) parallel to the first longitudinal edge (B3),
- and a partial transversal cut (V), parallel to the first transversal edge (B1), which divides and separates the single cardboard sheet (F) into a first sheet section (F1), comprised between the first transversal edge (B1) and the partial transversal cut (V), and into a second sheet section (F2), comprised between the partial transversal cut (V) and the second transversal edge (B2), wherein the first sheet section (F1) and the second sheet section (F2) are partially separated from one another by the partial transversal cut (V) but remain joined and connected to one another only at two sheet portions (p1, p2) comprised respectively between the two ends of the partial transversal cut (V) and the two longitudinal borders (B3, B4) of the single cardboard sheet (F) and defining respectively a first hinge point (a1) and a second hinge point (a2) between the first sheet section (F1) and the second sheet section (F2) (see for example in particular the left part of FIG. 2 in which the single cardboard sheet (F) which is obtained at the end of the cutting operations is illustrated).

The method then comprises advancing the single cardboard sheet (F) thus obtained along the advancement direction (A) and realising a longitudinal cut (L) in the first sheet section (F1), from the first transversal edge (B1) up to the partial transversal cut (V), in such a way as to divide the first sheet section (F1) into a first sheet half-section (F1A) and a second sheet half-section (F1B), wherein the first sheet half-section (F1A) remains hinged to the second sheet section (F2) by means of the first hinge point (a1) and the second sheet half-section (F1B) remains hinged to the second sheet section (F2) by means of the second hinge point (a2) (see for example in particular the right part of FIG. 2).

The method further comprises realising, in the second sheet section (F2), three transversal score lines (C1, C2, C3), parallel to one another, between the first longitudinal edge (B3) and the second longitudinal edge (B4), in such a way as to define: a first sector (S1) between the partial transversal cut (V) and a first transversal score line (C1), which will constitute a bottom wall (SF) of the box(S), a second sector (S2) between the first transversal score line (C1) and a second transversal score line (C2), which will constitute a first lateral wall (SL1) of the box(S), a third sector (S3) between the second score line (C2) and the third transversal score line (C3), which will constitute an upper wall (SU) of the box(S), and a fourth sector (S4) between the third score line (C3) and the second transversal edge (B2), which will constitute a second lateral wall (SL2) of the box(S) (in this regard see for example in particular the right part of FIG. 2).

Figure 3:
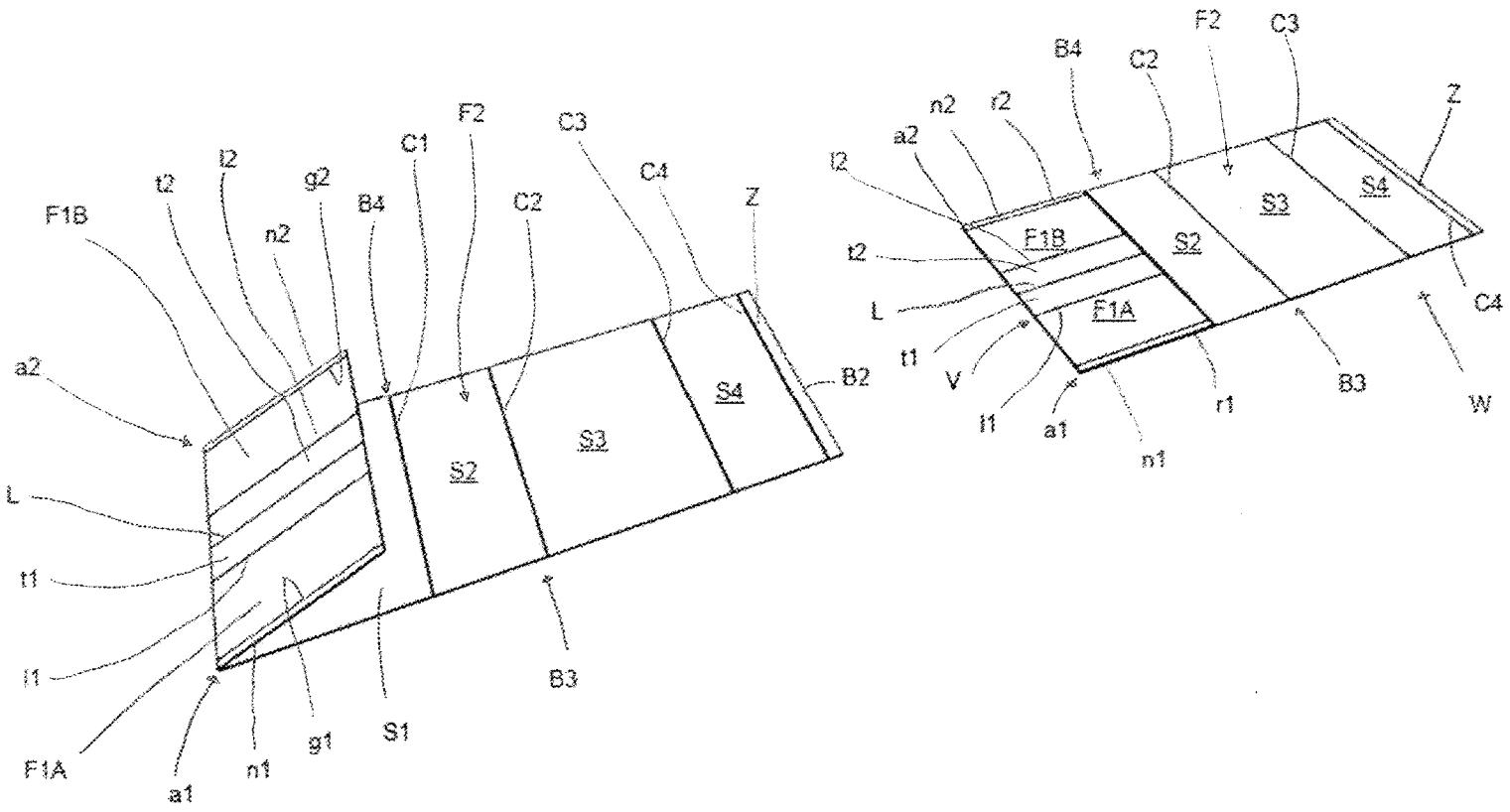

The method further comprises rotating the first sheet half-section (F1A) with respect to the first hinge point (a1) and rotating the second sheet half-section (F1B) with respect to the second hinge point (a2) so as to arrange them above the first sector (S1) of the second sheet section (F2) by gluing the first sheet half-section (S1) to the first sector (S1) at a first overlapping strip (r1) in proximity of the first longitudinal edge (B3) and by gluing the second sheet half-section (F1B) to the first sector (S1) at a second overlapping strip (r2) in proximity of the second longitudinal edge (B4) (see for example FIG. 3).

In this way, with the above-described operations, with the method of the invention, starting from a continuous cardboard strip (N), a cardboard blank (W) is obtained which will be used to realise the cardboard box(S) for packaging an article (B).

In this regard, the method further comprises, starting from the blank (W) illustrated in FIG. 3, rotating the first sheet half-section (F1A) with respect to the first sector (S1) about the first overlapping strip (r1) and rotating the second sheet half-section (F1B) with respect to the first sector (S1) about the second overlapping strip (r2) so as to arrange the first sheet half-section (F1A) and the second sheet half-section (F2B) at an angle with respect to the first sector (S1), wherein the first sheet half-section (F1A) will constitute a third lateral wall (SL3) of the box(S) and the second sheet half-section (F1B) will constitute a fourth lateral wall (SL4) of the box(S).

Figure 5:
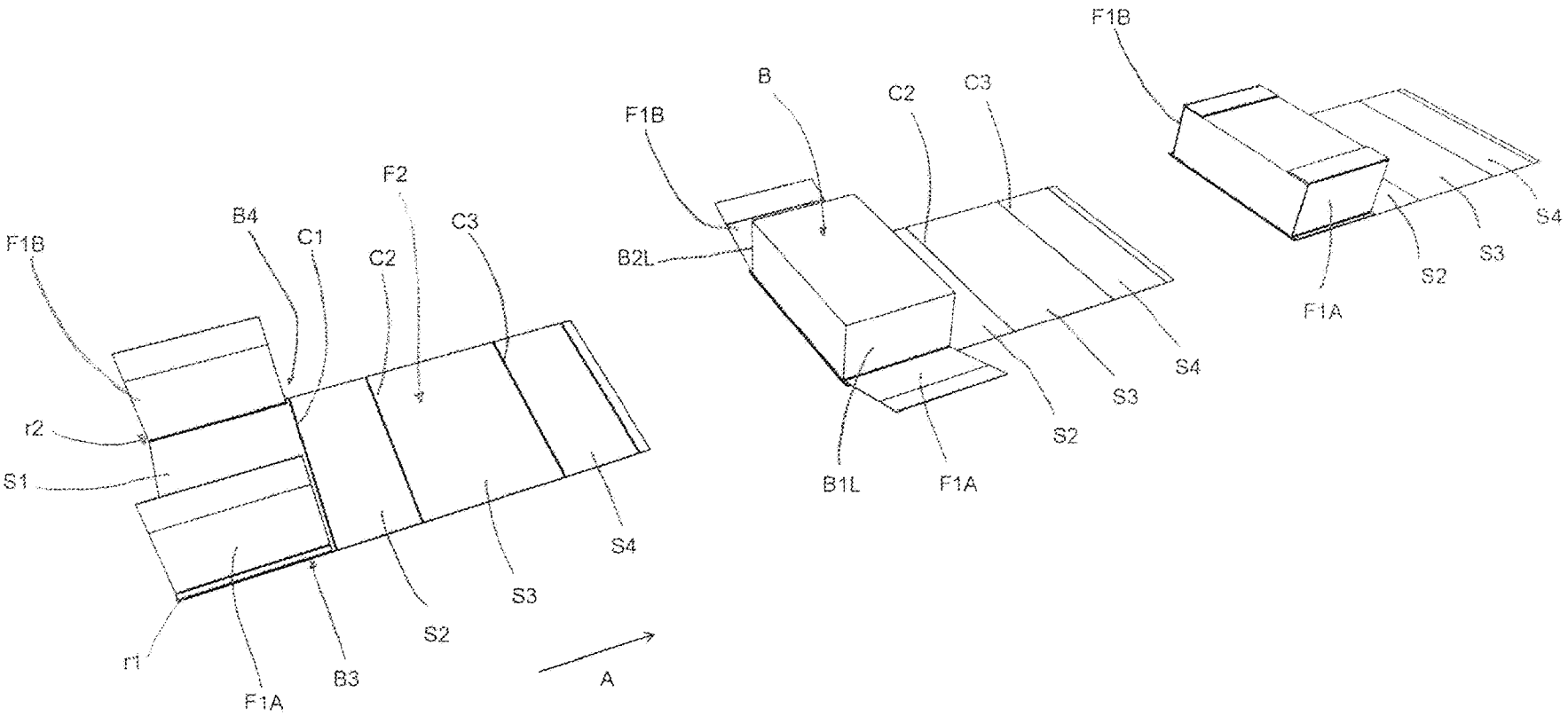
Figure 6:
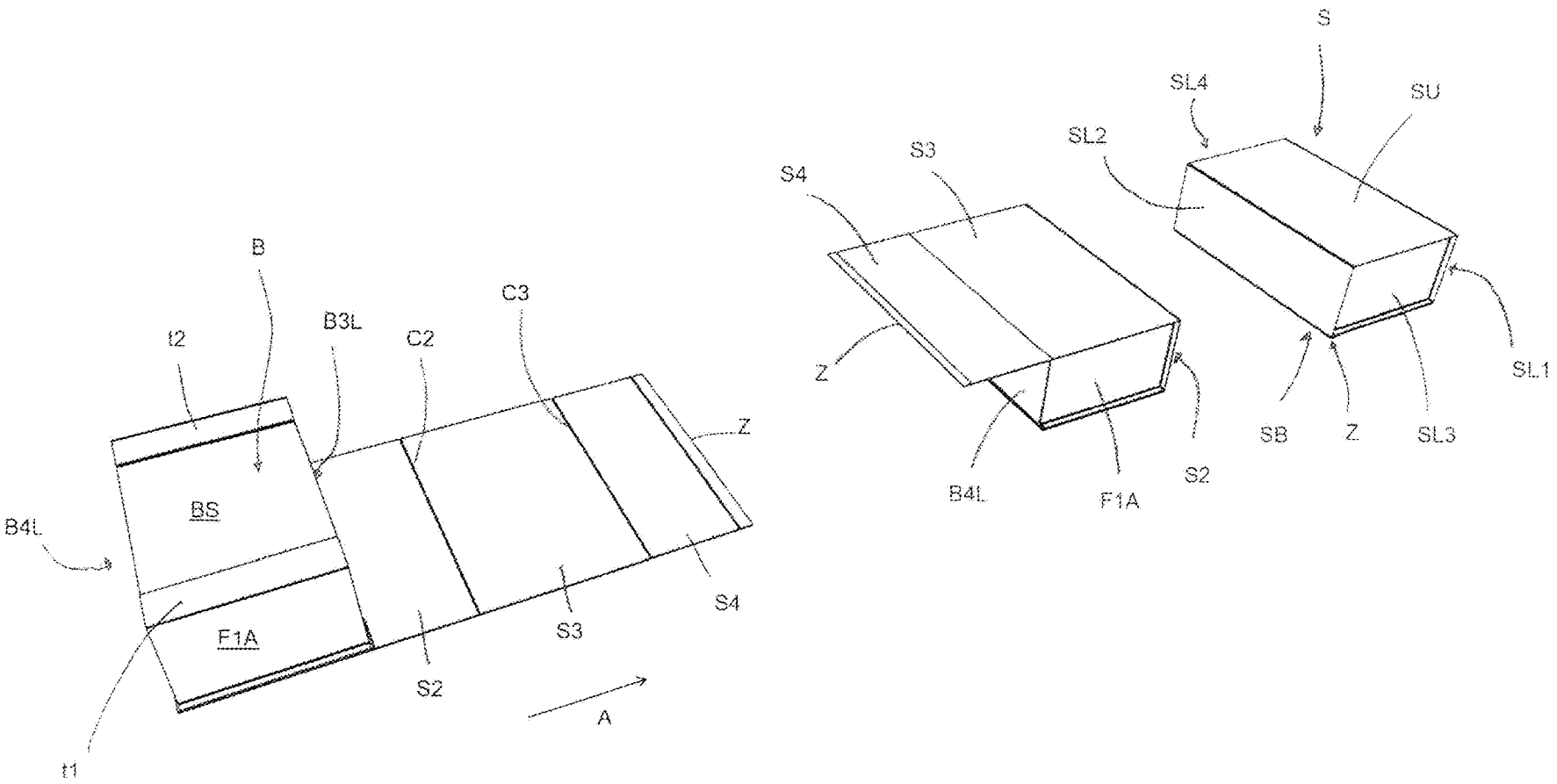

Therefore, by advancing the blank (W) with the first sheet half-section (F1A) and the second sheet half-section (F1B) at an angle with respect to the first sector (S1) of the second sheet section (F2), once more along the advancement direction (A), the method comprises resting an article (B) with the respective base face above the first sector (S1) of the second sheet section (F2) (see the central image of the sequence illustrated in FIG. 5), and further comprises:

- rotating the first sheet half-section (F1A) with respect to the first overlapping strip (r1) so as to arrange the first sheet half-section facing a first lateral face (B1L) of the article (B) and rotating the second sheet half-section (F1B) with respect to the second overlapping strip (r2) so as to arrange the second sheet half-section facing a second lateral face (B2L) of the article (B) (see for example the last image in the sequence of FIG. 5);
- rotating the second sector (S2) of the second sheet section (F2) about the first transversal score line (C1),
- rotating the third sector (S3) of the second sheet section (F2) about the second transversal score line (C2),
- rotating the fourth sector (S4) of the second sheet section (F2) about the third transversal score line (C3),
- so as to arrange the second sector (S2) facing a third lateral face (B3L) of the article (B), so as to arrange the third sector (S3) facing an upper face of the article (B) and the fourth sector (S4) facing a fourth lateral face (B4L) of the article (B) in such a way as to obtain a box(S) having a base wall (SB), four lateral walls (SL1, SL2, SL3, SL4) and an upper wall (SU) and containing the article (B) internally thereof (see the sequence of images illustrated in FIG. 6).

From the foregoing, it is clear how the method provided by the present invention enables packaging an article inside a cardboard box which is realised starting from a continuous cardboard strip which is cut so as to obtain a single cardboard sheet which, following the described operations, is transformed into a blank which, following the folding thereof about the article rested thereon, will form a cardboard box containing the article internally thereof with no waste or elimination of material (cardboard scraps or waste).

Further preferred aspects of the method of the present invention are described in the following.

The method can be carried out in such a way that the cutting operations carried out during the advancement of the continuous cardboard strip (N) along the advancement direction (A) so as to obtain the single cardboard sheet (F) from the continuous cardboard strip (N) comprise, indifferently: first transversally cutting the continuous cardboard strip (N) and separating, from the continuous cardboard strip (N), the single cardboard sheet (F) and then performing a partial transversal cut (V) on the single cardboard sheet (F), or making the partial transversal cut (V) on the continuous cardboard strip (N) and then transversally cutting the continuous cardboard strip (N) and obtaining the single cardboard sheet (F) with the partial transversal cut (V), or transversally cutting the continuous cardboard strip (N) and contemporaneously making the partial transversal cut (V).

In a further preferred aspect, the method can be carried out in such a way as to make the longitudinal cut (L) in the first sheet section (F1), from the first transversal edge (B1) up to the partial transversal cut (V), so as to divide the first sheet section (F1) into a first sheet half-section (F1A) and a second sheet half-section (F1B), contemporaneously, or before, or subsequently, to making the three transversal score lines (C1, C2, C3) in the second sheet section (F2).

Figure 4:
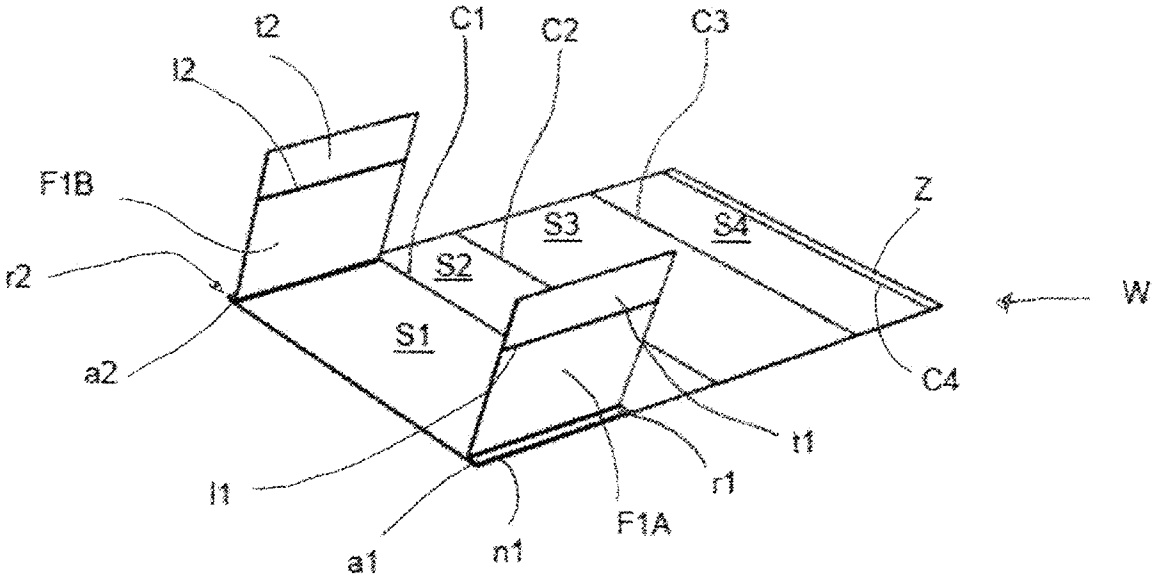

On the basis of a further possible preferred aspect, the method of the invention can comprise, before rotating the first sheet half-section (F1A) with respect to the first hinge point (a1), and rotating the second sheet half-section (F1*b*) with respect to the second hinge point (a2) so as to arrange them above the first sector (S1) of the second sheet section (F2), realising, on the first sheet half-section (F1A), a first longitudinal score line (l1), parallel to the first longitudinal edge (B3) of the single cardboard sheet (F), between the partial transversal cut (V) and the first transversal edge (B1) of the single cardboard sheet (F) in such a way as to define, on the first sheet half-section (F1A), a first wing (t1), and realising, on the second sheet half-section (F1B), a second longitudinal score line (l2), parallel to the second longitudinal edge (B4) of the single cardboard sheet (F), between the partial transversal cut (V) and the first transversal edge (B1) of the single cardboard sheet (F) in such a way as to define, on the second sheet half-section (F1B), a second wing (t2) (see for example FIGS. 3 and 4).

In this way, the first wing (t1) and the second wing (t2) are destined to be folded above the upper face (BS) of the article (B) once the first sheet half-section (F1A) and the second sheet half-section (F1B) have been rotated and arranged facing, respectively, the first lateral face (B1L) of the article (B) and the second lateral face (B2L) of the article (B) (see, for example, in particular FIG. 5, the last two images, and FIG. 6, first image).

In this way, adhesive material can be applied on the first wing (t1) and on the second wing (t2) before the third sector (S3) of the second sheet section (F2) is rotated and arranged on the upper face (BS) of the article, so that the third sector (S3), which will constitute the upper wall (SU) of the box(S), will be glued to the first wing (t1) and the second wing (t2).

In a further preferred aspect, the method of the invention can comprise, before rotating the first sheet half-section (F1A) with respect to the first hinge point (a1), and rotating the second sheet half-section (F1B) with respect to the second hinge point (a2) so as to arrange them above the first sector (S1) of the second sheet section (F2), realising a first fold line (g1) on the first sheet half-section (F1A) in proximity of the first longitudinal edge (B3) of the single cardboard sheet (F) so as to identify a first tab (n1), between the first fold line (g1) and the first longitudinal edge (B3), destined to be glued on the first sector (S1) of the second sheet section (F2) and to form the first overlapping strip (r1), and realising, on the second sheet half-section (F1B), a second fold line (g2) in proximity of the second longitudinal edge (B4) of the single cardboard sheet (F) so as to identify a second tab (n2), between the second fold line (g2) and the second longitudinal edge (B4), destined to be glued on the first sector (S1) of the second sheet section (F2) and to form the second overlapping strip (r2) (see FIGS. 2, 3, 4).

The method includes realising the first fold line (g1) and the second fold line (g2) in such a way that the distance between them is at least equal to the larger dimension of the base face (therefore, for example, the length of the base face) of the article (B) to be packaged.

In this way, when the first sheet half-section (F1A) and the second sheet half-section (F1B) are rotated and arranged above the first sector (S1) and glued thereto with the two wings (n1, n2), forming the two overlapping strips (r1, r2), the distance between the two overlapping strips (r1, r2) is at least equal to the larger dimension of the base face (and therefore the length of the base face) of the article (B) to be packaged.

In the preferred first embodiment described, the method can comprise, before rotating the second sector (S2), the third sector (S3) and the fourth sector (S4) of the second sheet section (F2), realising a fourth transversal score line (C4) in the fourth sector (S4), between the first longitudinal edge (B3) and the second longitudinal edge (B4), and in proximity of the second transversal edge (B2) so as to identify, between the fourth transversal score line (C4) and the second transversal edge (B2), a closing tab (z).

After the fourth sector (S4) of the second sheet section (F4) has been rotated and arranged facing the fourth lateral face (BL4) of the article (B), to form a lateral wall (SL2) of the box(S), the closing tab (z) can be rotated and folded about the fourth transversal score line (C4) so as to be glued to the base wall (SB) of the box, and thus to close the box.

Figures from 7 to 13 illustrate a further preferred embodiment of the method of the invention, which is particularly advantageous in the cases where the height of the article (B) to be packaged, i.e. the height of the lateral vertical corners of the four lateral faces (B1L, B2L, B3L, B4L) of the article (B), has a considerable entity, for example greater than about 10 cm.

When the height of the article to be packaged is particularly relevant, also the height of the lateral walls of the box that is formed is consequently high, and the four lateral vertical corners of the box are the parts of the box that are, so to speak, the weakest, and subject to any deformations as a consequence of possible external stresses, such as for example impacts, or for the weight that might bear down on them, when the boxes are stacked on one another.

This other preferred embodiment is however not exclusively limited to this particular situation, but can also be actuated in a case in which the article to be packaged is of a lower height, so as to obtain in any case a box able to prevent deformations at the fourth lateral vertical corners.

Figure 7:
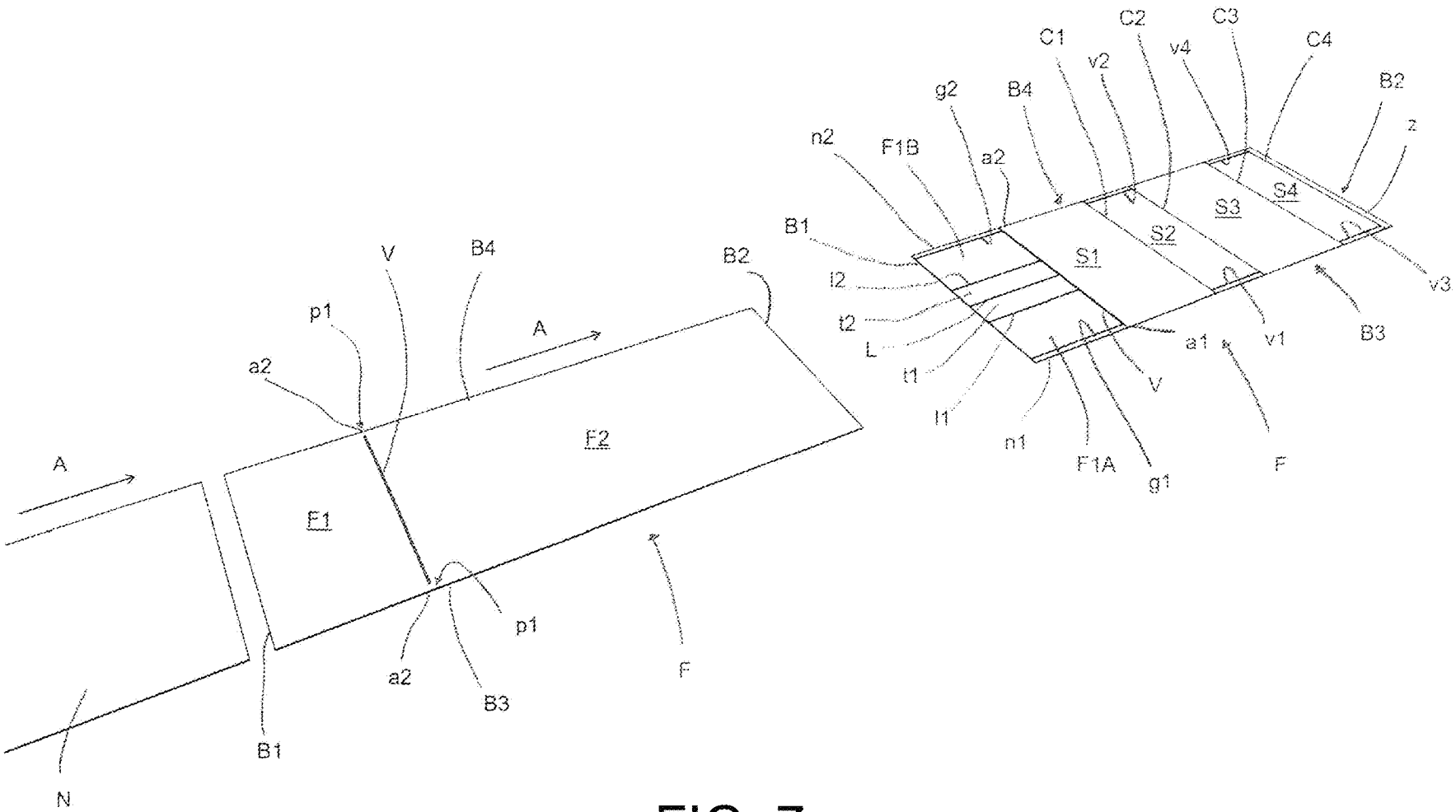
FIG. 7 illustrates, in a schematic perspective view, some special steps of the method of the invention according to a further possible preferred embodiment.
Figure 8:
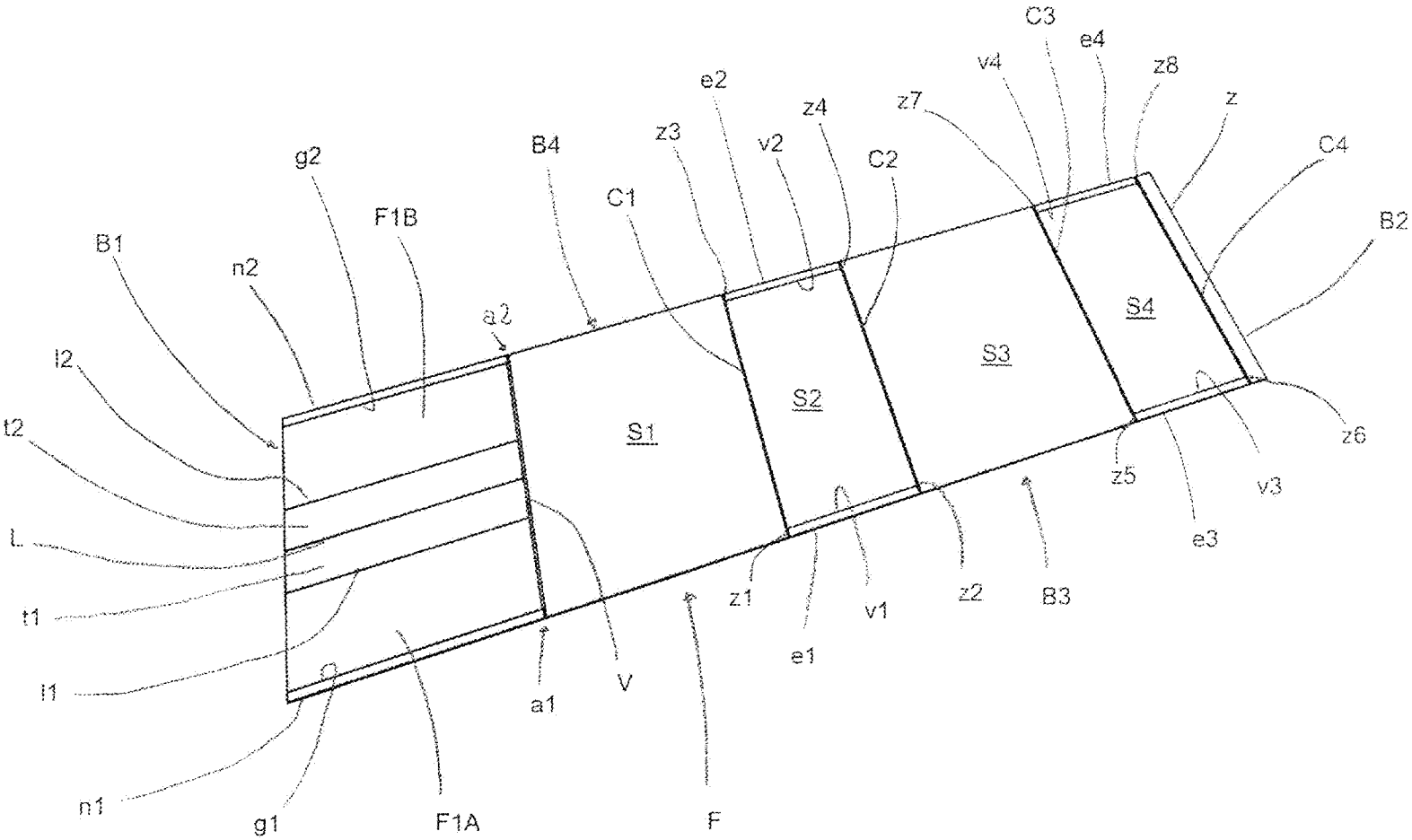
FIGS. 8 to 12 illustrate, in respective lateral schematic perspective views, further steps of carrying out the method of the invention based on the second preferred embodiment thereof.

In this regard, and advantageously, in this further preferred embodiment, before rotating the first sheet half-section (F1A) with respect to the first hinge point (a1), and before rotating the second sheet half-section (F1*b*) with respect to the second hinge point (a2) so as to arrange them above the first sector (S1) of the second sheet section (F2), the method can comprise (see for example in particular the right part of FIG. 7, and FIG. 8):

realising in the second sector (S2) between the first transversal score line (C1) and the second transversal score line (C2), a first longitudinal fold line (v1), parallel to the first longitudinal edge (B3), and a second longitudinal fold line (v2), parallel to the first longitudinal fold line (v1) and to the second longitudinal edge (B4), so that the first longitudinal fold line (v1) and the second longitudinal fold line (v2) are distanced from one another by a first distance that is at least equal to the distance between the lateral vertical corners of the third lateral face (B3L) of the article (B) to be packaged;

realising, in the fourth sector (S4), between the third transversal score line (C3) and the fourth transversal score line (C4), a third longitudinal fold line (v3), parallel to the first longitudinal edge (B3), and a fourth longitudinal fold line (v4), parallel to the third longitudinal fold line (v3) and to the second longitudinal edge (B4), in such a way that the third longitudinal fold line (v3) and the fourth longitudinal fold line (v4) are distanced from one another by a second distance that is at least equal to the distance between the lateral vertical corners of the fourth lateral face (B4L), opposite the third lateral face (B3L) of the article (B) to be packaged.

The method further comprises, contemporaneously, or subsequently to the realising of the first (v1), second (v2), third (v3) and fourth (v4) longitudinal fold line, realising:

a first transversal cut (z1), at the first transversal score line (C1), starting from the first longitudinal edge (B3) up to at most the first longitudinal fold line (v1), and a second transversal cut line (z2), at the second transversal score line (C2), starting from the first longitudinal edge (B3) up to at most the first longitudinal fold line (v1), in such a way as to form a first reinforcing tab (e1) comprised between the first longitudinal fold line (v1) and the first longitudinal edge (B3);

a third transversal cut (z3), at the first transversal score line (C1), starting from the second longitudinal edge (B4) up to at most the second longitudinal fold line (v2), and a fourth transversal cut (z4), at the second transversal score line (C2), starting from the second longitudinal edge (B4) up to at most the second longitudinal fold line (v2), in such a way as to form a second reinforcing tab (e2) comprised between the second longitudinal fold line (v2) and the second longitudinal edge (B4);

a fifth transversal cut (z5), at the third transversal score line (C3), starting from the first longitudinal edge (B3) up to at most the third longitudinal fold line (v3), and a sixth transversal cut (z6), at the fourth transversal score line (C4), starting from the first longitudinal edge (B3) up to at most the third longitudinal fold line (v3), in such a way as to form a third reinforcing tab (e3) comprised between the third longitudinal fold line (v3) and the first longitudinal edge (B3);

a seventh transversal cut (z7), at the third transversal score line (C3), starting from the second longitudinal edge (B4) up to at most the fourth longitudinal fold line (v4), and an eighth transversal cut (z8), at the fourth transversal score line (C4), starting from the second longitudinal edge (B4) up to at most the fourth longitudinal fold line (v4), in such a way as to form a fourth reinforcing tab (e4) comprised between the fourth longitudinal fold line (v4) and the second longitudinal edge (B4).

Figure 9:
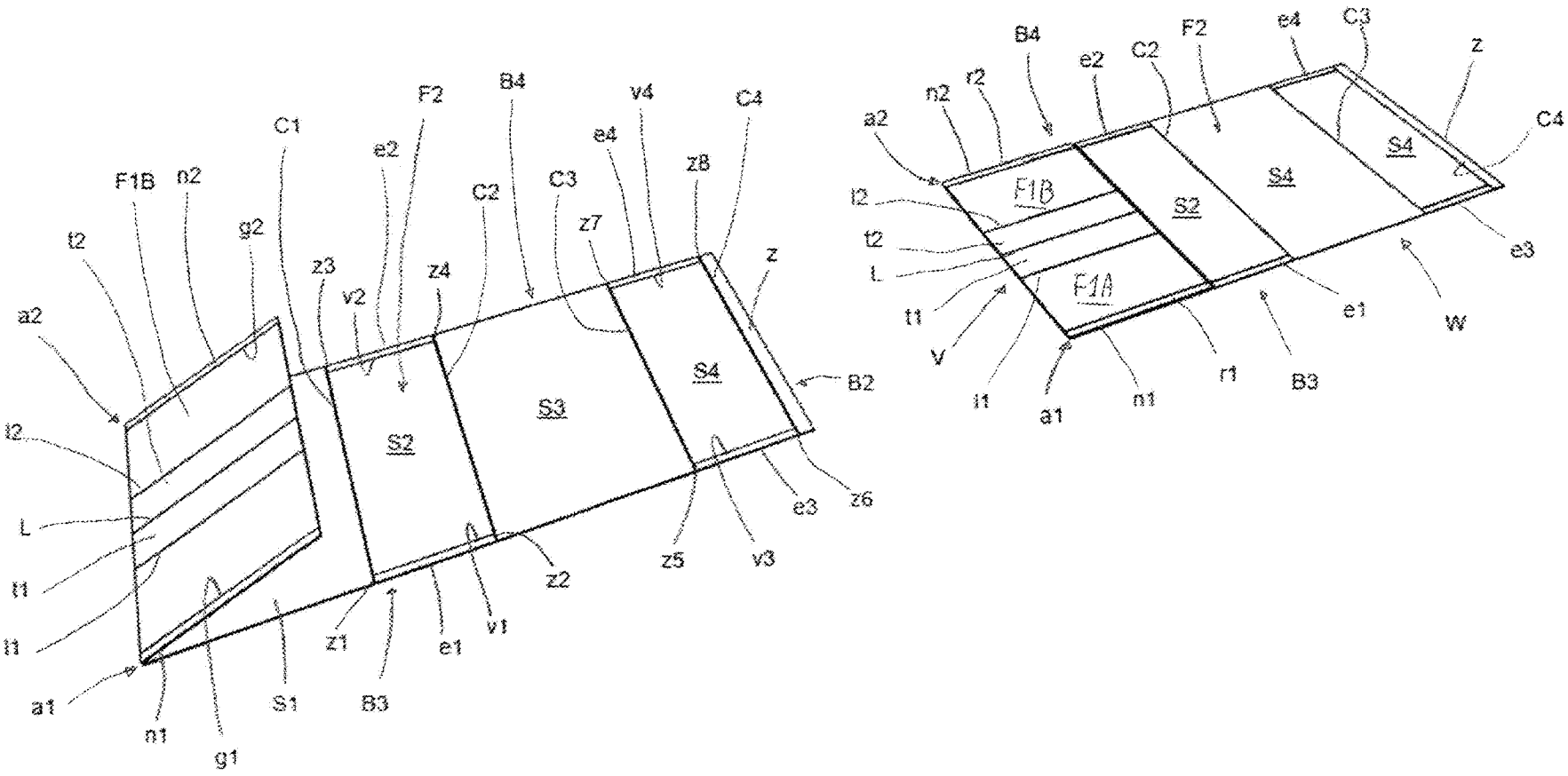
Figure 10:
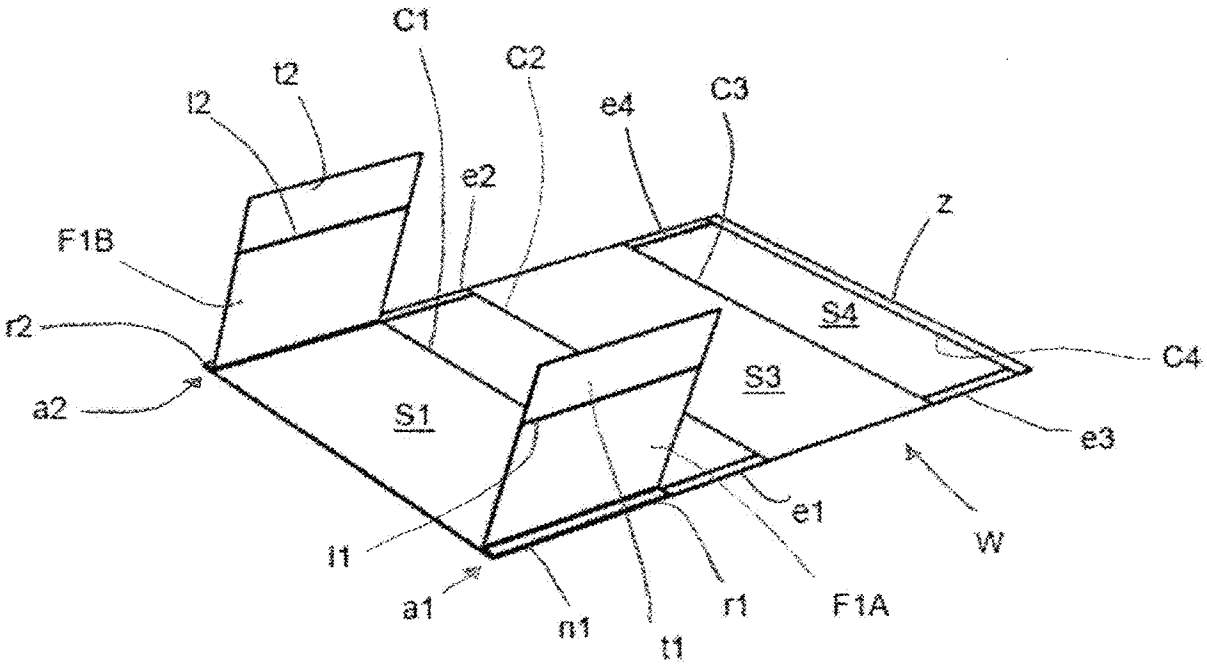
Figure 11:
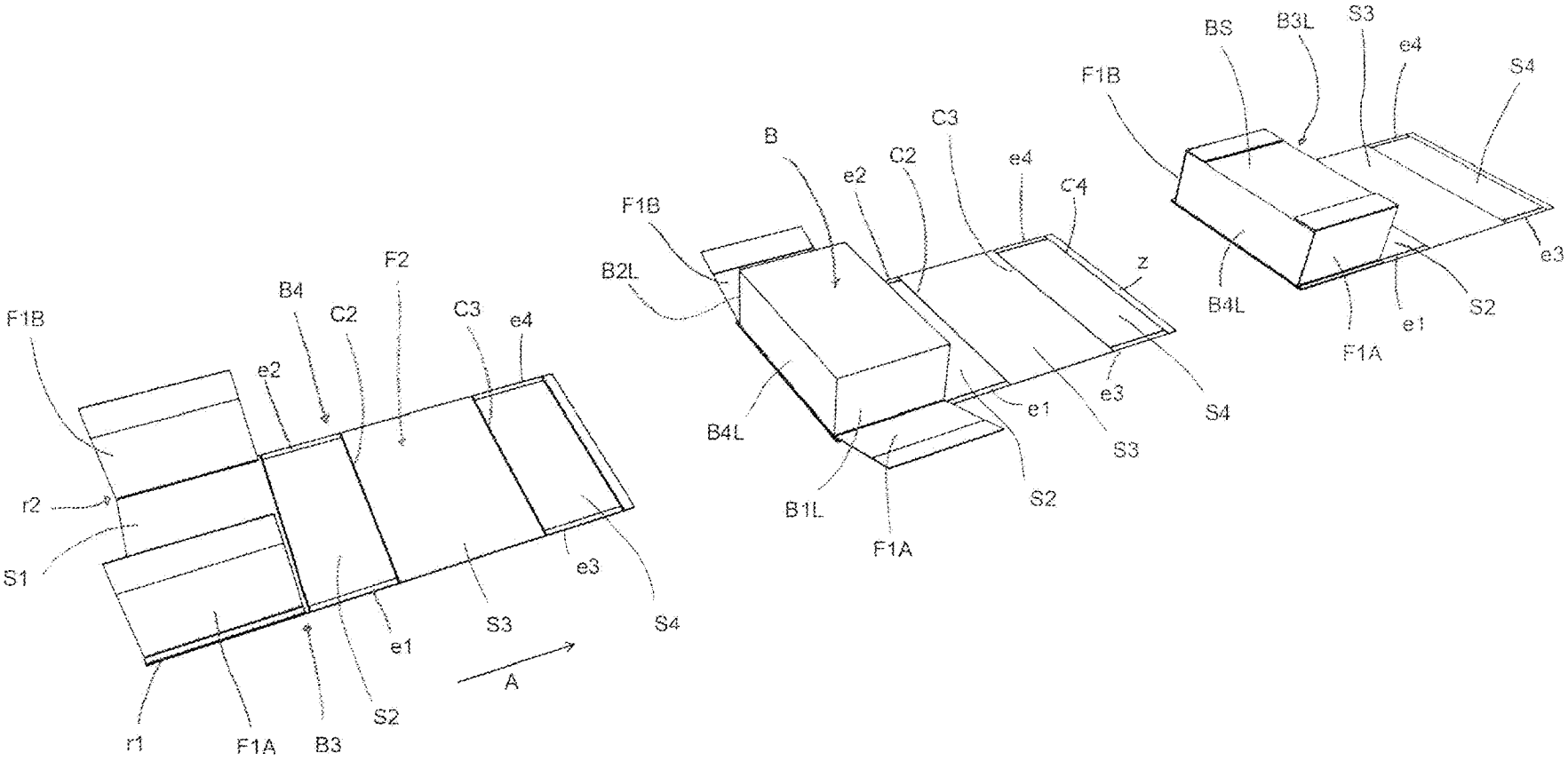
Figure 12:
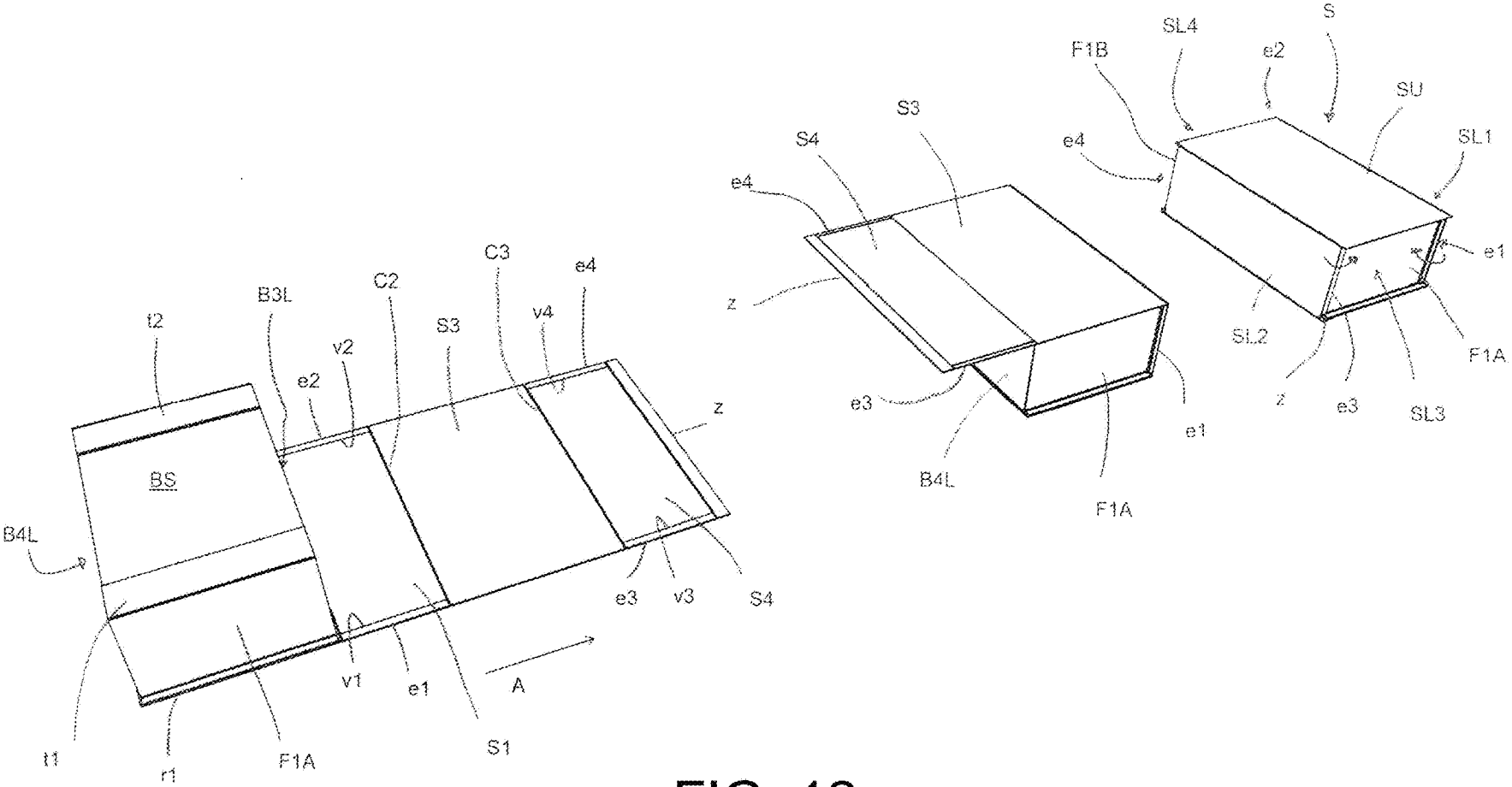

Further, the method comprises carrying out the operations illustrated in the sequence of figures from 9 to 12 so as to form the cardboard box(S) about an article (B), i.e:

rotating the first sheet half-section (F1A) with respect to the first hinge point (a1) and rotating the second sheet half-section (F1*b*) with respect to the second hinge point (a2) so as to arrange them above the first sector (S1) of the second sheet section (F2) by gluing the first sheet half-section (S1) to the first sector (S1) at a first overlapping strip (r1) in proximity of the first longitudinal edge (B3) and by gluing the second sheet half-section (F1B) to the first sector (S1) at a second overlapping strip (r2) in proximity of the second longitudinal edge (B4), obtaining the cardboard blank (W) (see for example FIG. 9);

rotating the first sheet half-section (F1A) with respect to the first sector (S1) about the first overlapping strip (r1) and rotating the second sheet half-section (F1B) with respect to the first sector (S1) about the second overlapping strip (r2) so as to arrange the first sheet half-section (F1A) and the second sheet half-section (F2B) at an angle with respect to the first sector (S1), wherein the first sheet half-section (F1A) will constitute a third lateral wall (SL3) of the box(S) and the second sheet half-section (F1B) will constitute a fourth lateral wall (SL4) of the box(S) (see FIG. 10);

resting an article (B) with the respective base face on the first sector (S1) of the second sheet section (F2) (see the central image of the sequence illustrated in FIG. 11), rotating the first sheet half-section (F1A) with respect to the first overlapping strip (r1) so as to arrange the first sheet half-section facing a first lateral face (B1L) of the article (B) and rotating the second sheet half-section (F1B) with respect to the second overlapping strip (r2) so as to arrange the second sheet half-section facing a second lateral face (B2L) of the article (B) (see for example the last image in the sequence of FIG. 11);

rotating the second sector (S2) of the second sheet section (F2) about the first transversal score line (C1), rotating the third sector (S3) of the second sheet section (F2) about the second transversal score line (C2), rotating the fourth sector (S4) of the second sheet section (F2) about the third transversal score line (C3), so as to arrange the second sector (S2) facing a third lateral face (B3L) of the article (B), and to form the first lateral wall (SL1) of the box(S), so as to arrange the third sector (S3) facing an upper face of the article (B), in order to form the upper wall (SU) of the box(S), and the fourth sector (S4) facing a fourth lateral face (BL4) of the article (B), in order to form the second lateral wall (SL2) of the box(S); in such a way as to obtain a box(S) having a base wall (SB), four lateral walls (SL1, SL2, SL3, SL4) and an upper wall (SU) and containing the article (B) internally thereof (see the sequence of images illustrated in FIG. 12).

Figure 13:
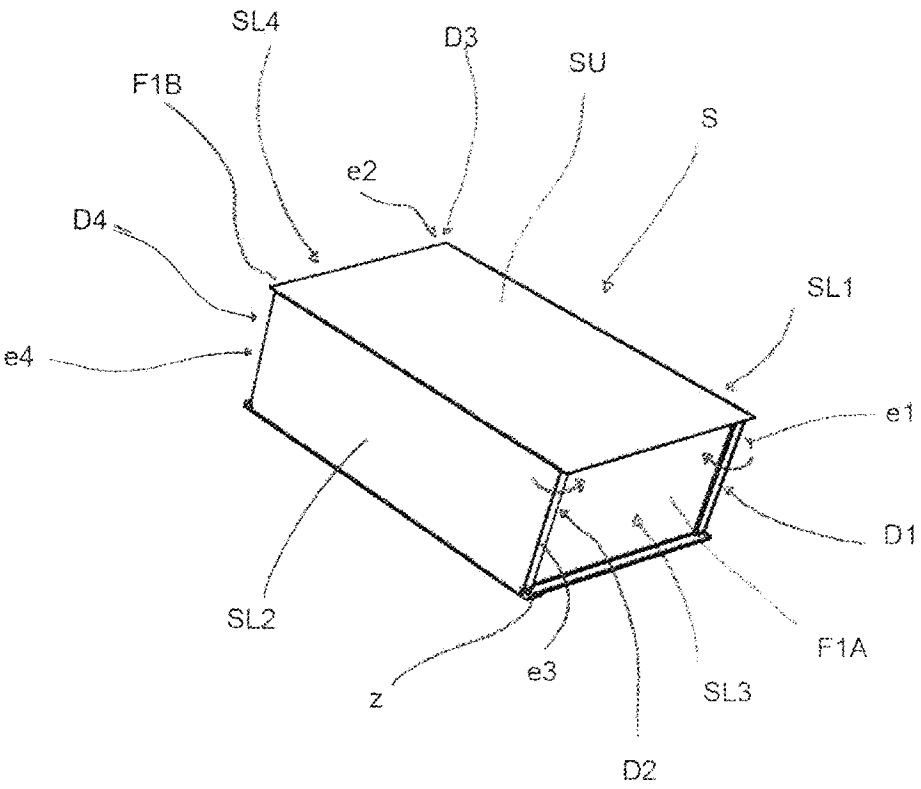
FIG. 13 illustrates, schematically in a perspective view, the cardboard box that can be obtained by carrying out the method of the invention in the second preferred embodiment thereof.

As illustrated in FIG. 12 (the two images on the right and in FIG. 13), the first reinforcing tab (e1) and the third reinforcing tab (e3) will be projecting with respect to the first sheet half-section (F1A), which constitutes the third lateral wall (SL3) of the box(S), and the second reinforcing tab (e2) and the fourth reinforcing tab (e4) will be projecting with respect to the second sheet half-section (F1B) which constitutes the fourth lateral wall (SL4) of the box(S), opposite the third lateral wall (SL3).

At this point, the method, this second preferred embodiment, further comprises (see for example the last image in FIG. 12, or FIG. 13):

rotating the first reinforcing tab (e1), with respect to the first longitudinal fold line (v1), and rotating the third reinforcing tab (e3) parallel to the third longitudinal fold line (v3), so as to fold and fix the tabs by gluing, against the first sheet half-section (F1A) (third lateral wall (SL3) of the box(S), which had been folded and which is facing a first lateral wall (B1L) of the article (B), so as to form a first pair of reinforced lateral vertical corners (D1, D2 of the cardboard box;

rotating the second reinforcing tab (e2), with respect to a second longitudinal fold line (v2), and rotating the fourth reinforcing tab (e4) with respect to the fourth longitudinal fold line (v4), so as to fold and fix the tabs by gluing, against the second sheet half-section (F1B) (fourth lateral wall (SL4) of the box(S)), which had been folded and which is facing a second lateral wall (B2L) of the article (B), opposite the first lateral wall (B1L), so as to form a second pair of reinforced lateral vertical corners (D3, D4) of the cardboard box(S).

The method preferably comprises applying adhesive material on the first (e1), second (e2), third (e3) and fourth (e4) reinforcing tab, or on vertical portions of the first sheet half-section (F1A) or on the second sheet half-section (F1B), before folding the first (e1), second (e2), third (e3) and fourth (e4) reinforcing tab against the first sheet half-section (F1A) and the second sheet half-section (F1B), for mutual fixing thereof.

In this way, a cardboard box(S) can be obtained, with the relative packaged article (B) inside, having the respective four reinforced lateral vertical corners (D1, D2, D3, D4), and therefore being able to resist any stresses and avoiding possible deformations of the box, for example, but not exclusively, in the cases in which the height of the article is for example greater than about 10 cm.

The invention claimed is:

1. A method for packaging an article in a cardboard box realised starting from a continuous cardboard strip, the method comprising:

advancing a continuous cardboard strip along an advancement direction;

carrying out cutting operations during the advancement of the continuous cardboard strip along the advancement direction so as to obtain a single cardboard sheet from the continuous cardboard strip, wherein the single cardboard sheet has:

a first transversal edge, a second transversal edge parallel to the first transversal edge, a first longitudinal edge and a second longitudinal edge parallel to the first longitudinal edge, wherein a partial transversal cut, parallel to the first transversal edge, which divides and separates the single cardboard sheet into a first sheet section, comprised between the first transversal edge and the partial transversal cut, and into a second sheet section, comprised between the partial transversal cut and the second transversal edge, wherein the first sheet section and the second sheet section are partially separated from one another by the partial transversal cut but remain joined and connected to one another only at two sheet portions comprised respectively between the two ends of the partial transversal cut and the two longitudinal borders of the single cardboard sheet and defining respectively a first hinge point and a second hinge point between the first sheet section and the second sheet section;

advancing the single cardboard sheet thus obtained along the advancement direction;

realising a longitudinal cut in the first sheet section, from the first transversal edge up to the partial transversal cut, in such a way as to divide the first sheet section into a first sheet half-section and a second sheet half-section, wherein the first sheet half-section remains hinged to the second sheet section by means of the first hinge point and the second sheet half-section remains hinged to the second sheet section by means of the second hinge point;

realising, in the second sheet section, three transversal score lines, parallel to one another, between the first longitudinal edge and the second longitudinal edge, in such a way as to define: a first sector between the partial transversal cut and a first transversal score line, which will constitute a bottom wall of the box, a second sector between the first transversal score line and a second transversal score line, which will constitute a first lateral wall of the box, a third sector between the second score line and the third transversal score line, which will constitute an upper wall of the box, and a fourth sector between the third score line and the second transversal edge, which will constitute a second lateral wall of the box;

rotating the first sheet half-section with respect to the first hinge point and rotating the second sheet half-section with respect to the second hinge point so as to arrange the first sheet half-section and the second sheet half-section above the first sector of the second sheet section by gluing the first sheet half-section to the first sector at a first overlapping strip in proximity of the first longitudinal edge and by gluing the second sheet half-section to the first sector at a second overlapping strip in proximity of the second longitudinal edge;

rotating the first sheet half-section with respect to the first sector about the first overlapping strip and rotating the second sheet half-section with respect to the first sector about the second overlapping strip so as to arrange the first sheet half-section and the second sheet half-section at an angle with respect to the first sector, wherein the first sheet half-section will constitute a third lateral wall of the box and the second sheet half-section will constitute a fourth lateral wall of the box;

resting an article with a respective base face above the first sector of the second sheet section;

rotating the first sheet half-section with respect to the first overlapping strip so as to arrange the first sheet half-section facing a first lateral face of the article and rotating the second sheet half-section with respect to the second overlapping strip so as to arrange the second sheet half-section facing a second lateral face of the article; and rotating the second sector of the second sheet section about the first transversal score line, rotating the third sector of the second sheet section about the second transversal score line, rotating the fourth sector of the second sheet section about the third transversal score line, so as to arrange the second sector facing a third lateral face of the article, so as to arrange the third sector facing an upper face of the article and so as to arrange the fourth sector facing a fourth lateral face of the article in such a way as to obtain a box having a base wall, four lateral walls, an upper wall and containing the article internally thereof.

2. The method as claimed in claim 1, wherein the cutting operations during the advancement of the continuous cardboard strip along the advancement direction so as to obtain the single cardboard sheet from the continuous cardboard strip comprise: first transversally cutting the continuous cardboard strip and separating, from the continuous cardboard strip the single cardboard sheet and then performing the partial transversal cut on the single cardboard sheet, or making the partial transversal cut on the continuous cardboard strip and then transversally cutting the continuous cardboard strip and obtaining the single cardboard sheet with the partial transversal cut, or transversally cutting the continuous cardboard strip and contemporaneously making the partial transversal cut.

3. The method as claimed in claim 1, comprising making the longitudinal cut in the first sheet section, from the first transversal edge up to the partial transversal cut, in such a way as to divide the first sheet section into a first sheet half-section and a second sheet half-section, contemporaneously, or before, or subsequently, to making the three transversal score lines in the second sheet section.

4. The method as claimed in claim 1, comprising, before rotating the first sheet half-section with respect to the first hinge point, and rotating the second sheet half-section with respect to the second hinge point so as to arrange the first sheet half-section and the second sheet half-section above the first sector of the second sheet section, realising on the first sheet half-section a first longitudinal score line, parallel to the first longitudinal edge of the single cardboard sheet, between the partial transversal cut and the first transversal edge of the single cardboard sheet in such a way as to define on the first sheet half-section a first wing, and realising on the second sheet half-section a second longitudinal score line, parallel to the second longitudinal edge of the single cardboard sheet, between the partial transversal cut and the first transversal edge of the single cardboard sheet in such a way as to define on the second sheet half-section a second wing, wherein the first wing and the second wing are destined to be folded above the upper face of the article once the first sheet half-section and the second sheet half-section have been rotated and arranged facing, respectively, the first lateral face of the article and the second lateral face of the article.

5. The method as claimed in claim 1, comprising, before rotating the first sheet half-section with respect to the first hinge point, and rotating the second sheet half-section with respect to the second hinge point so as to arrange the first sheet half-section and the second sheet half-section above the first sector of the second sheet section, realising a first fold line on the first sheet half-section in proximity of the first longitudinal edge of the single cardboard sheet so as to identify a first tab, between the first fold line and the first longitudinal edge, destined to be glued on the first sector of the second sheet section and to form the first overlapping strip, and realising a second fold line on the second sheet half-section in proximity of the second longitudinal edge of the single cardboard sheet so as to identify a second tab, between the second fold line and the second longitudinal edge, destined to be glued on the first sector of the second sheet section and to form the second overlapping strip.

6. The method as claimed in claim 1, comprising, before rotating the second sector, the third sector and the fourth sector of the second sheet section, realising a fourth transversal score line in the fourth sector, between the first longitudinal edge and the second longitudinal edge, and in proximity of the second transversal edge so as to identify, between the fourth transversal score line and the second transversal edge, a closing tab, wherein the closing tab, after the fourth sector of the second sheet section has been rotated and arranged facing the fourth lateral face of the article, to form a lateral wall of the box, is rotated and folded about the fourth transversal score line so as to be glued to the base wall of the box, and then to close the box.

7. The method as claimed in claim 6, comprising, before rotating the first sheet half-section with respect to the first hinge point and rotating the second sheet half-section with respect to the second hinge point so as to arrange the first sheet half-section and the second sheet half-section above the first sector of the second sheet section:

realising in the second sector, between the first transversal score line and the second transversal score line, a first longitudinal fold line, parallel to the first longitudinal edge, and a second longitudinal fold line, parallel to the first longitudinal fold line and to the second longitudinal edge, in such a way that the first longitudinal fold line and the second longitudinal fold line are distanced from one another by a first distance that is at least equal to the distance between the lateral vertical corners of the third lateral face of the article to be packaged;

realising in the fourth sector, between the third transversal score line and the fourth transversal score line, a third longitudinal fold line, parallel to the first longitudinal edge, and a fourth longitudinal fold line, parallel to the third longitudinal fold line and to the second longitudinal edge, in such a way that the third longitudinal fold line and the fourth longitudinal fold line are distanced from one another by a second distance that is at least equal to the distance between the lateral vertical corners of the fourth lateral face, opposite the third lateral face of the article to be packaged, and comprising, at the same time, or subsequently to the realising of the first, second, third and fourth longitudinal fold line, realising:

a first transversal cut, at the first transversal score line, starting from the first longitudinal edge up to at most the first longitudinal fold line, and a second transversal cut line, at the second transversal score line, starting from the first longitudinal edge up to at most the first longitudinal fold line, in such a way as to form a first reinforcing tab comprised between the first longitudinal fold line and the first longitudinal edge;

a third transversal cut, at the first transversal score line, starting from the second longitudinal edge up to at most the second longitudinal fold line, and a fourth transversal cut, at the second transversal score line, starting from the second longitudinal edge up to at most the second longitudinal fold line, in such a way as to form a second reinforcing tab comprised between the second longitudinal fold line and the second longitudinal edge;

a fifth transversal cut, at the third transversal score line, starting from the first longitudinal edge up to at most the third longitudinal fold line, and a sixth transversal cut, at the fourth transversal score line, starting from the first longitudinal edge up to at most the third longitudinal fold line, in such a way as to form a third reinforcing tab comprised between the third longitudinal fold line and the first longitudinal edge;

a seventh transversal cut, at the third transversal score line, starting from the second longitudinal edge up to at most the fourth longitudinal fold line, and an eighth transversal cut, at the fourth transversal score line, starting from the second longitudinal edge up to at most the fourth longitudinal fold line, in such a way as to form a fourth reinforcing tab comprised between the fourth longitudinal fold line and the second longitudinal edge, so that, once the cardboard box has been formed, the first reinforcing tab and the third reinforcing tab will be projecting with respect to the first sheet half-section, which constitutes a third lateral wall of the box, and the second reinforcing tab and the fourth reinforcing tab will be projecting with respect to the second sheet half-section which constitutes a fourth lateral wall of the box, opposite the third lateral wall, and wherein the method further comprises:

rotating the first reinforcing tab, with respect to the first longitudinal fold line, and rotating the third reinforcing tab with respect to the third longitudinal fold line, so as to fold and fix the first reinforcing tab and the third reinforcing tab, by gluing, against the first sheet half-section, which had been folded and which is facing a first lateral wall of the article, so as to form a first pair of reinforced lateral vertical corners of the cardboard box;

rotating the second reinforcing tab, with respect to the second longitudinal fold line, and rotating the fourth reinforcing tab with respect to the fourth longitudinal fold line, so as to fold and fix the second reinforcing tab and the fourth reinforcing tab, by gluing, against the second sheet half-section, which had been folded and which is facing a second lateral wall of the article, opposite the first lateral wall, so as to form a second pair of reinforced lateral vertical corners of the cardboard box.

8. The method as claimed in claim 7, comprising applying adhesive material on the first, second, third and fourth reinforcing tab, or on vertical portions of the first sheet half-section or on the second sheet half-section, before folding the first, second, third and fourth reinforcing tab against the first sheet half-section and the second sheet half-section, for mutual fixing thereof.

* * * * *